United States Patent [19]

Nishizawa

[11] 4,219,796

[45] Aug. 26, 1980

[54] SEMI-FIXED TYPE VARIABLE RESISTOR

[75] Inventor: Hideo Nishizawa, Muko, Japan

[73] Assignee: Murata Manufacturing Co., Ltd., Japan

[21] Appl. No.: 967,481

[22] Filed: Dec. 7, 1978

[30] Foreign Application Priority Data

Dec. 17, 1977 [JP] Japan ..... 52-170126

[51] Int. Cl.[2] ..... H01C 10/32

[52] U.S. Cl. ..... 338/163; 338/174

[58] Field of Search ..... 338/160, 162, 163, 167, 338/174

[56] References Cited

U.S. PATENT DOCUMENTS 3,032,734 5/1962 Zunker et al. ..... 338/163

*Primary Examiner*—C. L. Albritton

*Attorney, Agent, or Firm*—Ostrolenk, Faber, Gerb & Soffen

[57] ABSTRACT

A semi-fixed type variable resistor for use in electrical and electronic equipment which includes an electrically insulating substrate, a semi-circular resistor member formed on the substrate, a slider member of similar semi-circular shape rotatably mounted on the substrate to slide over the resistor member, and a cover member rotatably mounted on the substrate and also serving as a knob for rotating the slider member. The cover member has a protrusion formed at the forward end portion of its shaft so as to be readily engaged with a sleeve portion of a conductive plate provided on the substrate for reduction in cost and improvement of reliability of the variable resistor.

9 Claims, 8 Drawing Figures

SEMI-FIXED TYPE VARIABLE RESISTOR

BACKGROUND OF THE INVENTION

The present invention relates to an electrical resistor and more particularly, to a variable resistor of semi-fixed type having a cover member also serving as a knob for use in electrical and electronic equipment.

As a result of recent advances in the electrical and electronic industries, there has been an increasing demand for variable resistors of the above described type, especially those of compact size which may be incorporated into various kinds of electrical and electronic equipment.

As shown by way of example in FIGS. 1 and 2, the known semi-fixed variable resistor R of the above described type generally comprises a base portion B including a substrate or base plate 1 having, for example, a rectangular configuration and made of insulating material such as bakelite and the like, a semi-circular or arcuate resistor member 2 formed on the substrate 1, a slider member 7 of similar semi-circular shape rotatably mounted on the substrate 1 to slide over the resistor member 2, and a cover member 8 mounted on the substrate 1 and also serving as a knob for rotating the slider member 7.

In the conventional variable resistor of FIGS. 1 and 2, opposite ends of the arcuate resistor member 2 are connected through electrode conductors 3*a* and 3*b* to terminal electrodes 4*a* and 4*b*, respectively. Terminal electrodes 4*a* and 4*b* are one edge of the substrate 1 and extend downwardly from said substrate 1. An opening 5 is formed in the substrate 1 at the center of an arc defined by said arcuate resistor member 2. A cylindrical sleeve 6*b* is formed on an electrically conductive plate 6 and is fitted into the opening 5. Conducible plate 6 has a downwardly extending common terminal 6*a* at one end and an upwardly extending stop member 6*d* at the other. The distal end of the sleeve 6*b* is further inserted into a fixing opening 7*f* provided at the central portion of the slider member 7, with subsequent outward bending or staking at the distal end $6b_1$ of the sleeve 6*b* for rotatably mounting the slider member 7 on the substrate 1. Cover member 8 includes a shaft 8*c* which is made, for example, of thermo-plastic resin such as nylon and extends through the hollow interior of the sleeve 6*b*. A projection 7*a* is provided on slider member 7 and is engaged by a groove 8*b* formed in the bottom of a concentric recess 8*c* formed in the cover member 8. Such that a sliding portion 7*b* provided on the slider member 7 may slide over the resistor member 2 responsive to rotation of the cover member 8.

In the conventional arrangement described above, the cover member 8 has been rotatably mounted on the sleeve 6*b*, by extending the shaft 8*a* of the cover member 8 through the hollow interior of the sleeve 6*b* and fitting a retaining ring 10 around the projecting end or tip of the shaft 8*a* via a washer 9 which returns the shaft 8*a* in place. Alternatively, or to the diameter of the tip portion of the shaft 8*a* is made larger than that of the internal diameter of said sleeve 6*b*. This may be accomplished, for example, by providing a slot (not shown) at the projecting end of the shaft 8*a* or by deforming the tip portion through application of heat.

The cost of manufacturing semi-fixed variable resistors of the above described type must normally be held at a minimum. However, the known practice of retaining the cover member 8 by the use of the retaining piece 10 or by the deformation of the tip portion of the shaft 8*a* through application of heat as described with reference to FIG. 2 requires separate parts such as the retaining piece 10, washer 9, etc. and necessitates extra processes for attaching these parts or for heat processing of the tip portion of the shaft 8*a*, thus resulting in high cost of the semi-fixed variable resistor. Although the disadvantage as described above may be eliminated by providing the slot at the tip portion of the shaft 8*a*, there arises such a problem in this case that the slot formation in a resin molding die for the cover member 8 is very difficult, if the cover member 8 is of a small size.

SUMMARY OF THE INVENTION

Accordingly, an essential object of the present invention is to provide a semi-fixed type variable resistor for use in electrical and electronic equipment which is simple in construction through reduction in component parts, and can be manufactured at low cost with high working efficiency.

Another important object of the present invention is to provide a semi-fixed type variable resistor of the above described type which is compact in size, and stable in functioning with high reliability for incorporation into various electrical and electronic equipment.

In accomplishing these and other objects, according to one preferred embodiment of the present invention, there is provided a semi-fixed type variable resistor which comprises an electrically insulating substrate member having an arcuate resistor member formed on one surface thereof and an opening formed in the substrate member at a center of an arc defined by the arcuate resistor member, an electrically conductive plate member which has a sleeve portion extending upwardly therefrom and having external diameter fitting into said opening of the substrate member for inserting the sleeve portion into said opening from the other surface of the substrate member so as to cause said conductive plate member to contact the other surface of said substrate and also to cause the distal end of the sleeve portion to project from the one surface of said substrate member for fitting a fixing opening formed in a slider member onto the projecting distal end of the sleeve portion, with subsequent outward bending of the projecting distal end for movably mounting the slider member on the substrate member, and a cover member having a shaft portion extending outwardly therefrom to be rotatably mounted in the sleeve member for enabling a sliding portion of the slider member to slide over the resistor member upon rotation of the cover member. The shaft portion of the cover member is formed with retaining protrusion radially outwardly extending from a peripheral portion at a forward end of the shaft portion and having a maximum diameter larger than the internal diameter of the sleeve portion. The protrusion is sufficiently resilient to permit it to be inserted by hand through the sleeve portion but to retain the carrier member on the substrate member after the protrusion has been inserted through the sleeve portion and engages a corresponding edge of the sleeve member for rotatably mounting the cover member on the sleeve portion.

As a result of the above arrangement, it is no longer necessary to employ retaining pieces or special processing such as slot formation at the forward end of the cover member shaft for rotatably mounting the cover member on the substrate. Simplified structure demonstrates improved reliability and a reduction in cost of the variable resistor.

BRIEF DESCRIPTION OF THE DRAWINGS

These and other objects and features of the present invention will become apparent from the following description taken in conjunction with the preferred embodiment thereof with reference to the accompanying drawings, in which.

Before the description of the present invention proceeds, it is to be noted that like parts are designated by like reference numerals throughout several views of the accompanying drawings.

DETAILED DESCRIPTION OF THE INVENTION

Figure 1:
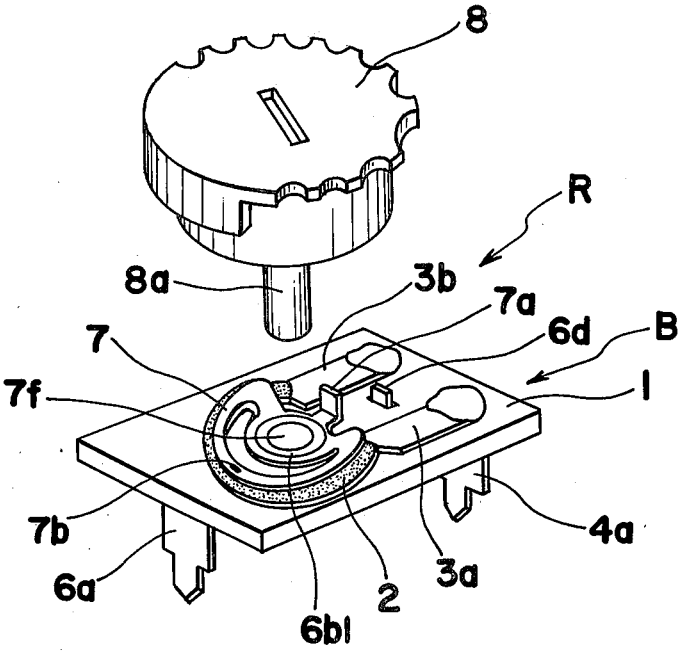
Fig. 1 PRIOR ART
FIG. 1 is a perspective view of a conventional semi-fixed type variable resistor with a cover member thereof detached for clarity (already referred to)
Figure 2:
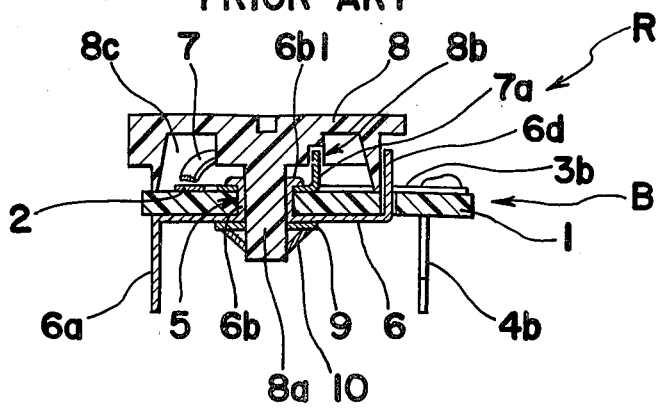
Fig. 2 PRIOR ART
FIG. 2 is a side sectional view of the semi-fixed type variable resistor of FIG. 1 particularly showing arrangement between the cover member and a substrate of the variable resistor (already referred to)
Figure 3:
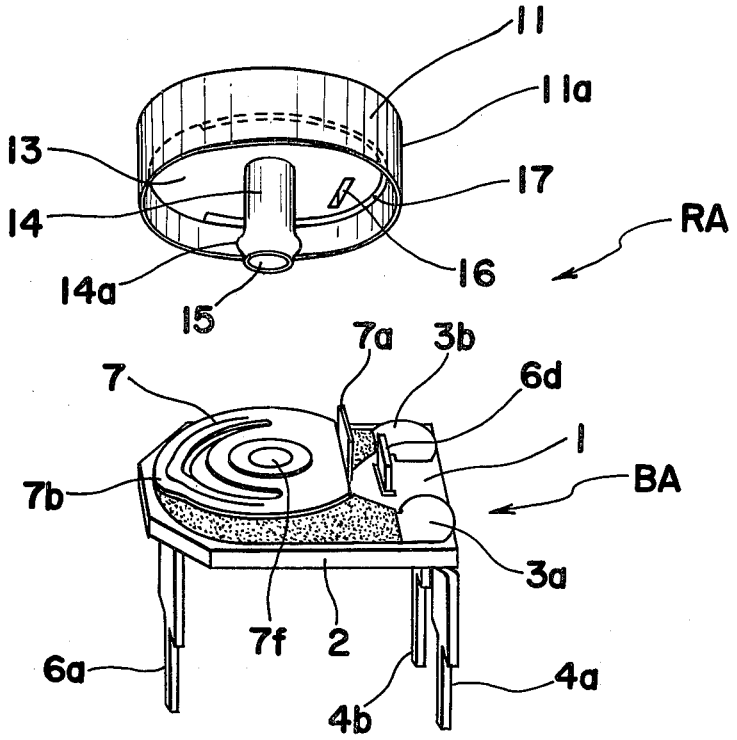
FIG. 3 is a perspective view of a semi-fixed type variable resistor according to one preferred embodiment of the present invention with a cover member thereof detached for clarity.
Figure 4:
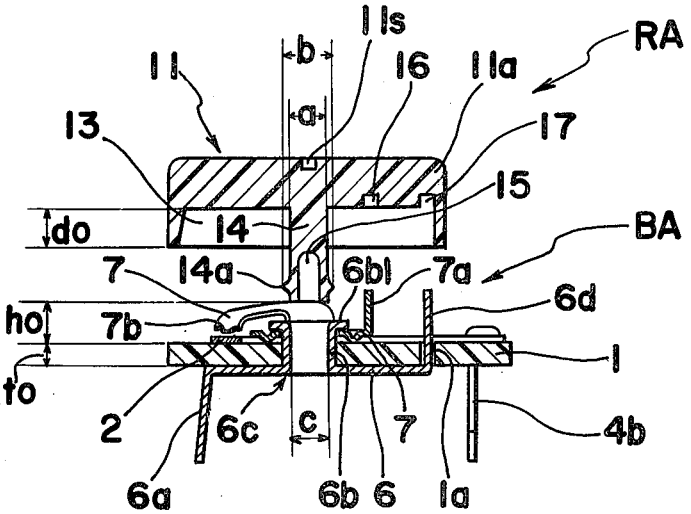
FIG. 4 is a side sectional view of the semi-fixed type variable resistor of FIG. 3.
Figure 5:
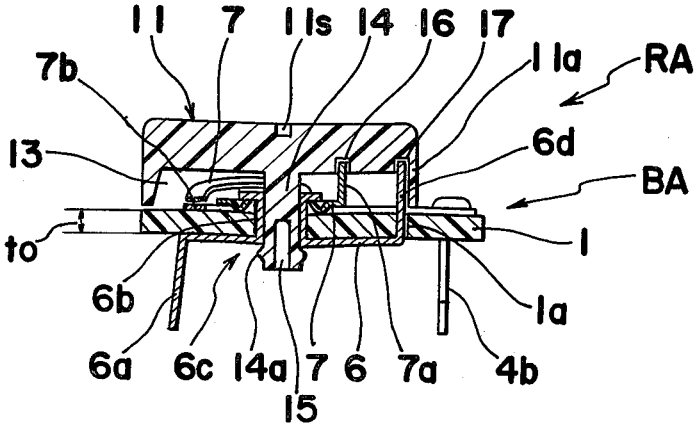
FIG. 5 is a similar view to FIG. 4, but particularly shows engagement between the cover member and a substrate of the variable resistor.
Figure 6:
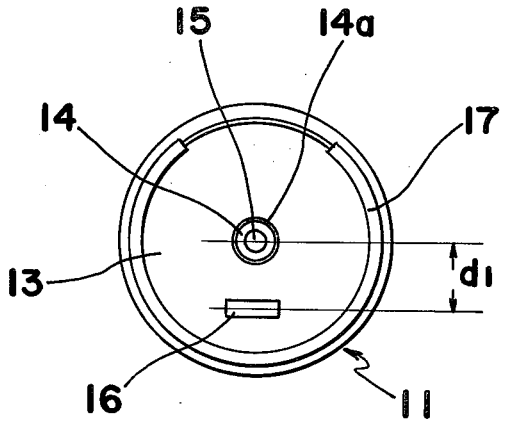
FIG. 6 is a bottom plan view of the cover member employed in the arrangement of FIGS. 3 to 5.

Referring now to the drawings, there is shown in FIGS. 3 to 5 a semi-fixed type variable resistor RA according to one preferred embodiment of the present invention. It should be noted here that in the arrangement of FIG. 3, the base portion BA of the variable resistor RA has a construction generally similar to the base portion B of the known variable resistor R of FIGS. 1 and 2 with minor alterations in the configurations of the component parts except for the novel structure of a cover member 11 directly related to the present invention. Accordingly, the description of the base portion BA is abbreviated with portions thereof which correspond to those of FIGS. 1 and 2 being designated by like reference numerals.

In the semi-fixed type variable resistor RA of the invention in FIGS. 3 to 5, the cover member 11 includes a cylindrical cover portion 11*a* formed by molding of nylon materials, for example, nylon 6 or nylon 66, glass fiber filled nylon material, etc. and having at its one surface a concentric recess 13 whose depth $d_0$ is slightly larger than a height $h_0$ from the surface of the substrate 1 to the highest point of the slider member 7 for enclosing therein the slider member 7, resistor member 2, etc., when mounted on the substrate 1, and a shaft or stem 14 of similar nylon material integrally formed with the cover portion 11*a* to have a diameter a equal to the internal diameter c of the sleeve 6*b* and extending outwardly at right angles from the central portion of the bottom of the recess 13.

Around the outer periphery of the shaft 14 adjacent to the distal end thereof, there is provided a protrusion or projection 14*a* which retains the cover member 11 in the opening in sleeve 6*c*. Projection 14*a* is formed simultaneously with the molding of the cover member 11 and permits cover member 11 to be rotatably coupled to sleeve 6*b*. The projection 14*a* is formed either continuously in an annular form or intermittently at a position slightly larger in distance than the sum of the depth $d_0$ of the recess 13 and thickness $t_0$ of the substrate 1 as measured from the bottom of the recess 13, while the maximum diameter b of the projection 14*a* is made larger than the internal diamter c of the sleeve 6*b* so that when the distal end of the shaft 14 is pressed into the sleeve 6*b* (the nylon shaft being resilient) through the opening 7*f* of the slider member 7, the projection 14*a* engages the peripheral edge 6*c* of the opening of the sleeve 6*b* at the side of the conductive plate 6. In this position, the cover member 11 is retained in the position illustrated in FIG. 5 and is rotatably coupled to sleeve 6*b*.

In the above arrangement, it is preferable to provide at the forward end of the shaft 14 a concentric bore 15 having a depth larger than the distance between the distal end face and the projection 14*a* of the shaft 14 for facilitation of deformation at the forward end of the shaft 14 so that the shaft 14 is readily pressed into the sleeve 6*b* during mounting of the cover member 11 onto the substrate 1.

Additionally, in the bottom of the recess 13 of the cover member 11 in a position, for example, at a distance $d_1$ from the axis of the shaft 14, there is provided a rectangular slot or groove 16 for receiving the projection 7*a* of the slider member 7 for enabling the slider member 7 to be rotated in response to rotation of the cover member 11. Another arcuate or C-shaped groove 17 is provided in the bottom of the recess 13 in a position along the peripheral edge of the recess 13 and surrounds the groove 16 so as to receive the stop member 6*d* of the conductive plate 6 extending upwardly through an opening 1*a* formed in the substrate 1 such that groove 17 restricts the angle of rotation of the cover member 11 and consequently, of the slider member 7, for example, to 30°. In the upper surface of the cover member 11 at the central portion thereof, there is formed a further groove 11*s* to receive, for example, a tip of a screw driver (not shown) for rotation of the cover member 11.

It is to be noted here that in the above arrangement, the relative positions of the rectangular groove 16 and arcuate groove 17 may be modified in various ways depending on necessity, for example, in such a manner that the arcuate groove 17 confronts the rectangular groove 16 instead of surrounding the latter as in the arrangement of FIG. 3, and that the length of the arcuate groove 17 may be altered to suit to the desired rotational angle of the cover member 11.

Figure 7:
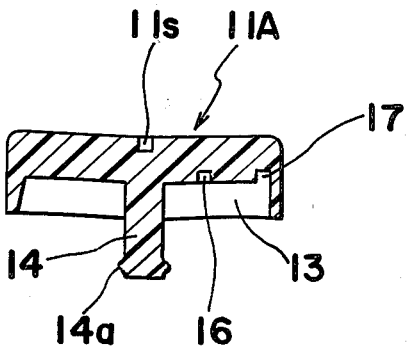
FIG. 7 is a side sectional view of a cover member according to a modification of the present invention.

It is also to be noted that as shown in a modified cover member 11A of FIG. 7, the concentric bore 15 may be omitted if resiliency of the material of the cover member can be utilized for the purpose, and that the base portion BA of the variable resistor RA may further be modified into various forms within the scope, provided that the base portion can receive the cover member 11 directly related to the present invention for proper mounting of the latter.

Figure 8:
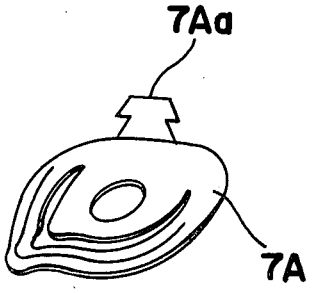
FIG. 8 is a perspective view showing a modification of the slider member applicable to the arrangement of FIGS. 3 to 5.

In FIG. 8, there is shown a modification of the slider member 7 employed in the arrangement of FIGS. 3 to 5. In the modified slider member 7A of FIG. 8, the projection 7A*a* for engagement with the groove 16 of the cover member 11 has saw tooth-like notches at opposite side edges thereof as shown for being pressed into said groove 16. As a result of this arrangement, the effect for preventing falling off of the cover member 11 by the protrusion 14*a* of the shaft 14 is further supplemented.

As is clear from the foregoing description, according to the present invention, since the cover member is arranged to be rotatably mounted on the insulating substrate through the protrusion formed at the forward end portion of the shaft during molding of the cover member, employment of the retaining piece or processing of the forward end portion of the shaft as in the conventional arrangements has advantageously been disposed with for consequent reduction in cost to a large extent, while the cover member is free from the possibility of falling off from the substrate due to reduction in the degree of opening at the slotted portion in the forward end portion of the shaft as in the case where the slot is provided at such forward end portion of the shaft, with a maked improvement on the reliability of the variable resistor.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. A variable resistor for use in electrical and electronic equipment comprising:

an electrically insulating substrate member having an arcuate resistor member provided on one surface thereof, an opening being formed in said substrate member at a center of an arc defined by said arcuate resistor member;

an electrically conductive plate member having a sleeve portion extending upwardly therefrom, said sleeve portion being inserted into said opening from a second surface of said substrate member in such a manner that said conductive plate member contacts said second surface of said substrate member and the distal end of said sleeve portion projects from said one surface of said substrate member;

a slider member having an opening formed therein, said projecting distal end of said sleeve portion extending through said opening in said slider member and cooperating with said slider member in such a manner that said slider member is rotatably mounted on said substrate member; and a cover member having a shaft portion extending outwardly therefrom, said cover member cooperating with said slider member and said substrate member in such a manner that when said shaft portion is inserted into said sleeve portion, said cover member is rotatable with respect to said substrate member and causes a sliding portion of said slider member to slide over said resistor member upon rotation of said cover member, said shaft portion of said cover member being formed with a retaining protrusion extending radially from a peripheral portion at a distal end of said shaft portion and having a maximum diameter larger than the internal diameter of said sleeve portion, said retaining protrusion being sufficiently resilient to permit said protrusion to be inserted by hand through said sleeve portion but to retain said cover member on said substrate member after said protrusion has been inserted through said sleeve portion with said protrusion engaging a corresponding edge of said sleeve portion for rotatably mounting said cover member on said sleeve portion.

2. A variable resistor as claimed in claim 1, wherein said retaining protrusion is an annular projection continuously formed on said peripheral portion at the distal end of said shaft portion.

3. A variable resistor as claimed in claim 1, wherein said retaining protrusion is a plurality of projections intermittently formed on said peripheral portion at the distal end of said shaft portion.

4. A variable resistor for use in electrical and electronic equipment, comprising:

an electrically insulating substrate member having an arcuate resistor member provided on one surface thereof, an opening being formed in said substrate member at a center of an arc defined by said arcuate resistor member;

an electrically conductive plate member having a sleeve portion extending upwardly therefrom, said sleeve portion being inserted into said opening from a second surface of said substrate member in such a manner that said conductive plate member contacts said second surface of said substrate member and the distal end of said sleeve portion projects from said one surface of said substrate member;

a slider member having an opening formed therein, said projecting distal end of said sleeve portion extending through said opening in said slider member and cooperating with said slider member in such a manner that said slider member is rotatably mounted on said substrate member;

a cover member having a shaft portion extending outwardly therefrom, said cover member cooperating with said slider member and said substrate member in such a manner that when said shaft portion is inserted into said sleeve portion, said cover member is rotatable with respect to said substrate member and causes a sliding portion of said slider member to slide over said resistor member upon rotation of said cover member, said shaft portion of said cover member being formed with a retaining protrusion extending radially from a peripheral portion at a distal end of said shaft portion and having a maximum diameter larger than the internal diameter of said sleeve portion so that upon insertion of said shaft portion through said sleeve portion, said protrusion engages a corresponding edge of said sleeve portion for rotatably mounting said cover member on said sleeve portion; and said shaft portion of said cover member being provided with a concentric bore formed in an end face of said distal end thereof and having a depth larger than the distance between said end face and said protrusion.

5. A variable resistor for use in electrical and electronic equipment, comprising:

an electrically insulating substrate member having an arcuate resistor member provided on one surface thereof, an opening being formed in said substrate member at a center of an arc defined by said arcuate resistor member;

an electrically conductive plate member having a sleeve portion extending therefrom, said sleeve portion being inserted into said opening from a second surface of said substrate member in such a manner that said conductive plate member contacts said second surface of said substrate member and the distal end of said sleeve portion projects from said one surface of said substrate member;

a slider member having an opening formed therein, said projecting distal end of said sleeve portion extending through said opening in said slider member and cooperating with said slider member in such a manner that said slider member is rotatably mounted on said substrate member; and a cover member having a shaft portion extending outwardly therefrom, said cover member cooperating with said slider member and said substrate member in such a manner that when said shaft portion is inserted into said sleeve portion, said cover member is rotatable with respect to said substrate member and causes a sliding portion of said slider member to slide over said resistor member upon rotation of said cover member, said shaft portion of said cover member being formed with a retaining protrusion extending radially from a peripheral portion at a distal end of said shaft portion and having a maximum diameter larger than the internal diameter of said sleeve portion so that upon insertion of said shaft portion through said sleeve portion, said protrusion engages a corresponding edge of said sleeve portion for rotatably mounting said cover member on said sleeve portion, said cover member being provided with a concentric recess in one surface thereof from which said shaft portion outwardly extends, said recess being formed, at the bottom thereof, with a groove adapted to receive a corresponding projection of said slider member for rotation of said slider member responsive to rotation of said cover member and another arcuate groove to engage another corresponding projection of said conductive member for restricting the permissible angle of rotation of said cover member and said slider member with respect to said substrate member.

6. A variable resistor as claimed in claim 5, wherein said another arcuate groove has a length which restricts said angle of rotation of said cover member and slider member to approximately 30°.

7. A variable resistor as claimed in claim 5, wherein said concentric recess of said cover member has a depth slightly larger than a height from the surface of said substrate member to the highest point of said slider member.

8. A variable resistor as claimed in claim 5, wherein said retaining protrusion is formed on the peripheral portion at the distal end of said shaft portion in a position spaced from the bottom of said concentric recess by a distance slightly larger than a sum of the depth of the concentric recess and a thickness of said substrate member.

9. A variable resistor as claimed in claim 5, wherein said corresponding projection of said slider member has saw tooth-like notches at opposite side edges thereof for being pressed into said groove of said cover member.

* * * * *